US010195894B2

(12) United States Patent
Bussie

(10) Patent No.: US 10,195,894 B2
(45) Date of Patent: Feb. 5, 2019

(54) ART MEDIUM SURFACE TREATMENT TOOL

(71) Applicant: Jacob G Bussie, Janesville, WI (US)

(72) Inventor: Jacob G Bussie, Janesville, WI (US)

( * ) Notice: Subject to any disclaimer, the term of this patent is extended or adjusted under 35 U.S.C. 154(b) by 564 days.

(21) Appl. No.: 14/516,181

(22) Filed: Oct. 16, 2014

(65) Prior Publication Data

US 2016/0107476 A1 Apr. 21, 2016

(51) Int. Cl.

| | |
|---|---|
| ***B43K 19/00*** | (2006.01) |
| ***B43L 13/24*** | (2006.01) |
| ***B43K 19/02*** | (2006.01) |
| ***B43K 23/016*** | (2006.01) |
| ***B43K 23/00*** | (2006.01) |
| ***B43K 24/14*** | (2006.01) |
| ***B44B 11/02*** | (2006.01) |
| ***B44D 5/10*** | (2006.01) |

(52) U.S. Cl.

CPC ..... *B43L 13/24* (2013.01); *B43K 19/00* (2013.01); *B43K 19/003* (2013.01); *B43K 19/006* (2013.01); *B43K 19/02* (2013.01); *B43K 23/00* (2013.01); *B43K 23/016* (2013.01); *B43K 24/14* (2013.01); *B44B 11/02* (2013.01); *B44D 5/10* (2013.01)

(58) Field of Classification Search

CPC ..... B43K 24/14; B43K 23/016; B43K 23/00; B43K 19/02; B43K 19/006; B43K 19/003; B43K 19/00; B43K 8/22; B43K 3/00; B44B 11/02; B43L 13/24; H02K 7/145; B44D 5/10

USPC ..... 401/88

See application file for complete search history.

(56) References Cited

U.S. PATENT DOCUMENTS

| | | | | |
|---|---|---|---|---|
| 2,242,475 | A * | 5/1941 | Misuraca | B23B 31/207 279/43 |
| 3,297,003 | A * | 1/1967 | Benson | B43K 8/22 15/3 |
| 3,368,090 | A * | 2/1968 | Miller | H02K 7/145 15/3.53 |
| 3,515,397 | A * | 6/1970 | Tucker | B23B 31/36 279/6 |
| 3,699,825 | A * | 10/1972 | Misuraca | B23B 45/001 15/3.53 |
| 3,997,972 | A * | 12/1976 | Jaunarajs | B43K 17/00 33/18.1 |
| 4,211,012 | A * | 7/1980 | Alles | B41J 2/5056 118/211 |

(Continued)

OTHER PUBLICATIONS

International Search Report and Written Opinion of the International Searching Authority dated Jan. 4, 2016 regarding International Application Serial No. PCT/US2015/055055.

*Primary Examiner* — Jennifer C Chiang
*Assistant Examiner* — Bradley Oliver
(74) *Attorney, Agent, or Firm* — Smith Keane LLP

(57) ABSTRACT

An art medium applicator includes a rotating shaft and an art medium coupled thereto for causing the medium to travel through an application path for transfer to a substrate. The applicator includes a coupling assembly, and may include an applicator tip including a cavity into which the art medium is inserted and supported. An art medium modifier includes a rotating shaft and an art medium modifier coupled thereto for causing the modifier to travel through an application path for modification of an art medium previously applied to a substrate.

5 Claims, 8 Drawing Sheets

(56) References Cited

U.S. PATENT DOCUMENTS

| | | | | | |
|---|---|---|---|---|---|
| 4,299,506 | A * | 11/1981 | Hashimoto | B43K 21/14 | 401/195 |
| 4,515,492 | A * | 5/1985 | Shan | A45C 11/34 | 206/224 |
| 4,599,799 | A * | 7/1986 | Lopez | B43L 13/24 | 33/18.1 |
| 5,044,804 | A * | 9/1991 | Chuang | B43K 5/005 | 401/34 |
| 5,208,987 | A * | 5/1993 | Christen | B43K 8/22 | 33/18.1 |
| 5,502,967 | A * | 4/1996 | Nakagawa | B43K 8/22 | 219/216 |
| 5,933,970 | A * | 8/1999 | Diresta | B43K 8/22 | 33/18.1 |
| 6,427,357 | B1 * | 8/2002 | Piper | B44B 3/061 | 33/18.1 |
| 6,499,896 | B1 * | 12/2002 | Sickler | B43K 8/22 | 15/437 |
| 7,207,242 | B1 * | 4/2007 | Daigle | A61M 37/0076 | 30/362 |
| 2008/0101844 | A1 * | 5/2008 | Liu | B43K 5/005 | 401/6 |

* cited by examiner

ART MEDIUM SURFACE TREATMENT TOOL

BACKGROUND OF THE INVENTION

Application of an art medium, such as ink, paint, graphite, charcoal, crayons, chalks, pastels, gum-, resin-, or wax-based or -impregnated pigmented pencil cores, etc., both by hand and with an applicator, are well known in the world of art. Application of these mediums to, or modification of such medium after application to, a substrate can leave the artist with hand and body strain as the repeated twisting, oscillating, and/or reciprocating motion used to apply them is very taxing. Additionally, as the hand and body tire or age, extended time periods of application are difficult to achieve, thus prolonging art projects. The field of art medium application and manipulation would benefit from a device that applies and manipulates art medium on a substrate with reduced wear on the artist.

SUMMARY OF THE INVENTION

The present invention relates to a device capable of applying an art medium onto and/or manipulating an art medium on a substrate and reduces hand and body strain associated with repetitive hand motion. The device provides an applicator tip which receives the art medium which is actually or effectively rotated, oscillated, and/or reciprocated by an electric motor.

An embodiment of a hand tool according to the present invention includes a shaft, which may be fluted along at least a portion of its length, rotatable about an axis of rotation and an art medium coupled to and moved by the shaft. At least a portion of the art medium travels through an application path surrounding the axis of rotation.

According to an aspect of a hand tool according to the present invention the shaft may be journaled into an electric motor, which may be powered by a power mains or a battery, such as a rechargeable battery.

According to another aspect of a hand tool according to the present invention, a coupling assembly may be secured to the shaft, between the shaft and the art medium. The coupling assembly may include a base connector secured to the shaft and a collar threadably engaged with the base connector.

According to still another aspect of a hand tool according to the present invention, an applicator tip may be disposed at least partially within a collar. The applicator tip may be formed of an acrylic material and may include a cavity into which the art medium is inserted. The cavity may be formed as a cylindrical cavity along a cavity axis that may be positioned coaxially or noncoaxially with the axis of rotation. The art medium may be selected from the group consisting of graphite, charcoal, wax crayon, chalk, pastel, gum-based pencil core, resin-based pencil core, wax-based pencil core, gum-impregnated pencil core, resin-impregnated pencil core, and wax-impregnated pencil core.

An embodiment of a method according to the present invention includes the steps of coupling an art medium to a shaft rotatable about an axis of rotation and rotating the shaft about the axis of rotation causing at least a portion of the art medium to travel through an application path surrounding the axis of rotation. While the at least a portion of the art medium is traveling through the application path, an amount of the art medium may be transferred to a substrate by bringing the substrate and art medium into physical contact.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
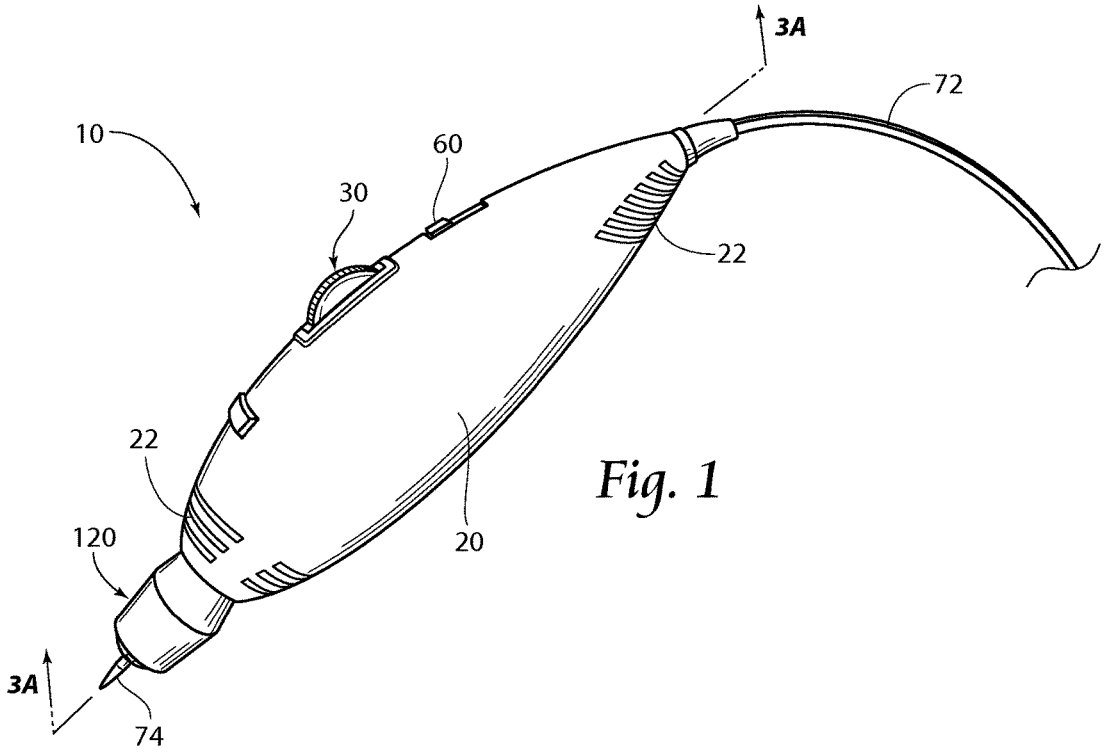
FIG. 1 is a perspective view of an art medium surface treatment tool with a first embodiment applicator tip according to the present invention.
Figure 2:
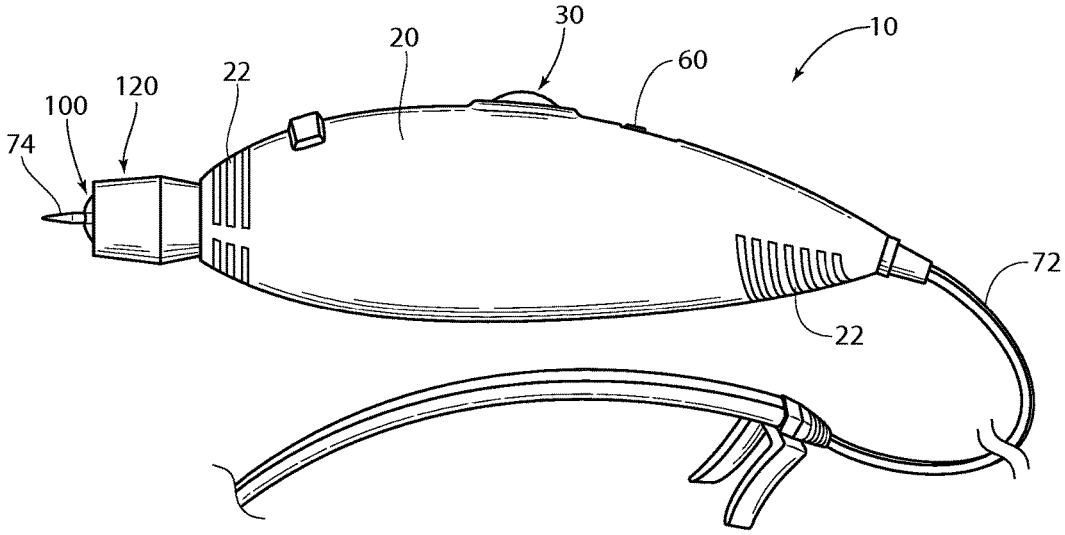
FIG. 2 is a side view of the tool shown in FIG. 1.

FIGS. 1 and 2 illustrate a preferred embodiment 10 of an art surface treatment tool. The tool preferably comprises a housing 20, a motor speed control 30, a motor 40 (see FIG. 3), control circuitry (see FIG. 3), and, as depicted here, a first embodiment applicator tip 100. The housing 20 may be configured to house the motor 40 and the control circuitry 50. Vents 22 may be placed in the housing 20 to allow ambient air exchange to provide ventilation of the motor 40 and the circuitry 50.

Looking to FIG. 3, the inside of the tool 10 may be seen. The motor 40 is preferably a direct current motor as is known in the art. A shaft 42 extends outward from the motor 40. The rotational speed of the shaft 42 is preferably in the range from 200 RPM up to and including 7500 RPM.

Additionally or alternatively, a fan blade (not shown) may be attached to the shaft 42 to move air through the housing 20.

In the embodiment of the tool 10 as shown, the motor 42 is preferably powered by an external power source (not shown) and connected to the power source by a cord 72 and plug with a transformer (not shown), which receives power through a power mains, such as through an electrical outlet (not shown), which may provide access to alternating current of 100-240 volts rms at a frequency of 25 to 133 Hertz, such as 120V/60 Hz as is common in the United States, or 230V/50 Hz as is common in Europe. Preferably the portion of the cord 72 nearest the tool 10 is comprised of a material that is flexible and without significant elastic memory, for example a silicone coated flexible power cable, to limit unwanted interference or influence on manipulation when the tool 10 is in use.

Additionally or alternatively, an internal or externally attached battery (not shown) can serve as the tool power source. Non-limiting examples of the types of batteries used to power the tool 10 include batteries from the lithium family, whereby lithium-ion batteries are preferable for instances in which rechargeable batteries are desired.

The control circuitry 50 is preferably located within the housing 20 and facilitates the transfer of power and signals from various power sources and inputs to the motor 40. The motor speed control 30 increases and decreases the revolutions per minute (RPM) of the shaft 42. The motor speed control 30 is preferably comprised of a potentiometer (not shown) operably connected to a speed control slide or wheel 32; however, it is contemplated that the tool 10 may additionally and/or alternatively incorporate a digital adjustable speed drive (not shown) in which speed control may be input by a user 80 (see FIG. 11) by way of the wheel 32 or other similar type of input mechanism (not shown), such as push buttons, switches, or a capacitive or resistive touch screen, and transmitted digitally to the motor 40 or a digital controller thereof, such as a microprocessor, ASIC, or discrete digital components.

A power switch 60 may be incorporated to switch the power delivered from the power source (not shown) to the control circuitry 50 on and off. Alternatively, power to the control circuitry 50 may be supplied and interrupted by merely coupling the electrical cord 72 to a power supply.

Additionally or alternatively, an optical sensor 62 (FIG. 3B) may be provided to control the distribution of power through the circuitry 50 to the motor 40. The speed of the motor 40 is preferably proportional to the amount of light sensed by the optical sensor 62. As a non-limiting example, the speed of the motor 40 increases when less light is detected by the optical sensor 62. The optical sensor 62 may also act as a switch to turn on and off the power delivered from the power source (not shown) to the control circuitry 50.

Figure 3A:
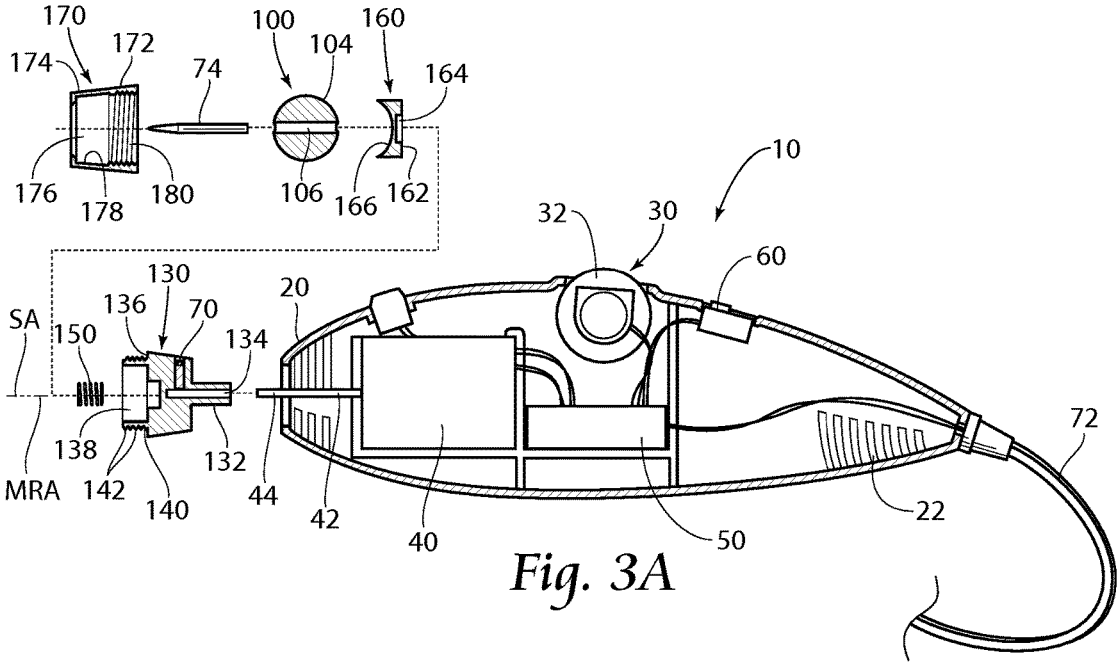
FIG. 3A is a cut-away view of the tool shown in FIG. 1.
Figure 3B:
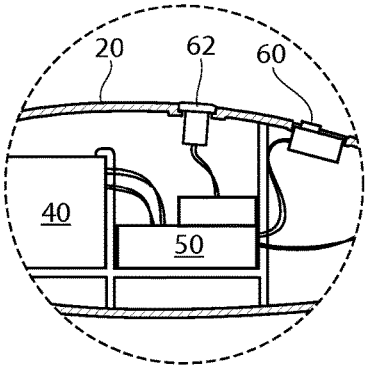
FIG. 3B is a cut-away view of an additional or alternative power switch or motor speed control according to the present invention.

As shown in FIG. 3A, the shaft 42 preferably rotates about a shaft axis SA arranged coaxially in relationship to the motor rotational axis MRA of the motor armature (not shown). The shaft 42 comprises an attachment portion 44 at least partially extending beyond the housing 20.

The first embodiment applicator tip 100 is shown more clearly in FIGS. 3A and 4-5B. The applicator tip 100 is preferably spherical with a diameter ATD1 and comprises a material having an elastic characteristic, as a non-limiting example, silicone. The applicator tip 100 preferably comprises a groove 102 about the periphery 104 along a circumference (e.g., the great circle) of the applicator tip 100. At least one substantially cylindrical cavity 106 having a diameter CD (see FIGS. 5A and 5B, CD' and CD", respectively) may be located within the groove 102 and preferably extends radially inward. The groove 102 preferably has a semi-circular profile with a diameter GD (see FIGS. 5A and 5B, GD' and GD", respectively). The groove diameter GD is preferably substantially the same dimension as the cavity diameter CD.

It is contemplated that various embodiments of the applicator tip 100 may be configured for various art mediums 74 based on the type of medium and/or the diameter of the art medium AMD from at least 0.5 millimeters to about 8 millimeters. FIG. 5 illustrates two applicator tips 100A, 100B having cavities 106A, 106B of different sizes for various sized art mediums 72. It is further contemplated that the applicator tip 100 comprises a plurality of cavities 106 of various sizes to accommodate art mediums 72 of different diameters.

Figure 4:
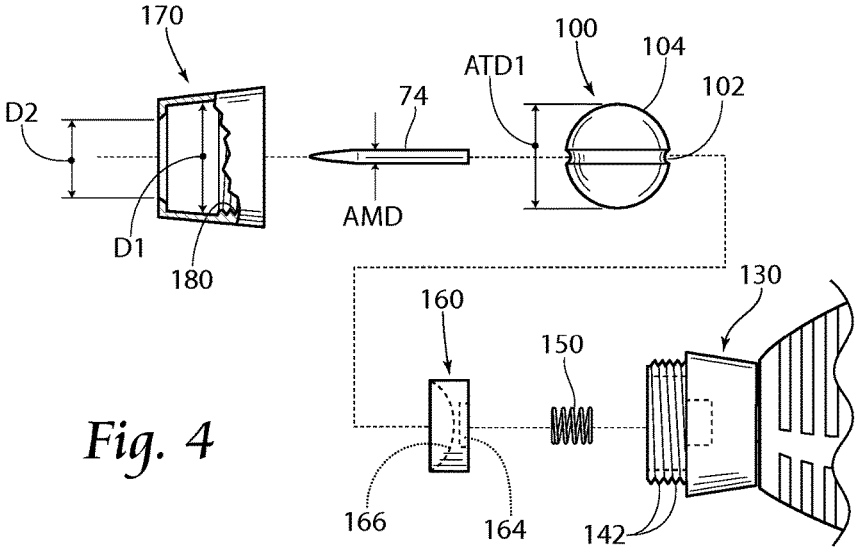
FIG. 4 is a partial exploded partial cut-away view of the first embodiment of the tool shown in FIG. 1.
Figure 5A:
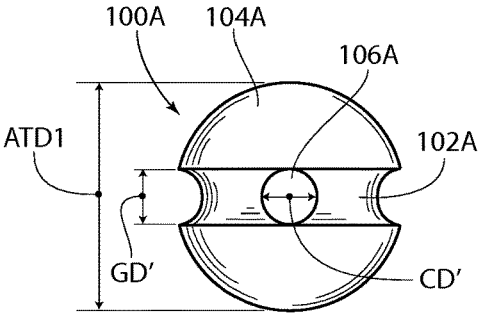
FIGS. 5A and 5B are side views of applicator tips according to the present invention.
Figure 5B:
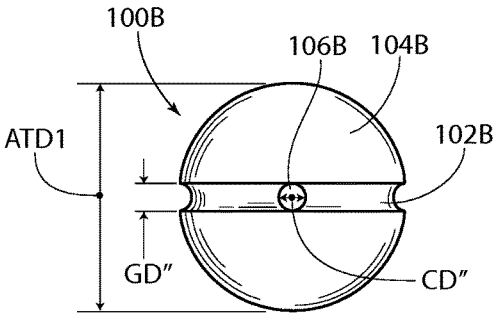

As depicted in FIGS. 3A and 4, the applicator tip 100 is preferably attachable to the shaft 42 via a coupling assembly 120 (reference number shown on FIGS. 1 and 2). The applicator tip 100 and the coupling assembly 120 are removably attachable for easy changing or adjusting of the applicator tip 100. The coupling assembly 120 preferably comprises a base connector 130, a biasing member 150, a dish 160, and a collar 170.

The base connector 130 has a first end portion 132 and a second end portion 136. The first end portion 132 preferably has a bore 134 sized and configured to receive the shaft 42, whereby the base connector 130 is preferably removably affixed to the shaft 42 by a set screw 70. The second end portion 136 preferably has a pocket 138 opposite the bore 134 and has a periphery 140 with external threads 142.

The dish 160 preferably has a flat surface 162 and a concave surface 166 opposite the flat surface 162 and is sized and configured to be received within the pocket 138 of the second end portion 136 of the base connector 130 in the orientation as depicted in FIGS. 3A and 4. The dish 160 may also comprise a recess 164 extending inward from the flat surface 162 as shown.

The collar 170 has a first segment 172, a second segment 174 adjoining the first segment 172, and a circular internal passage 176 extending through the first and second segments 172, 174. The internal passage 176 defines an internal passage surface 178. The internal passage surface 178 at the first segment 172 preferably comprises internal threads 180. The internal passage surface 178 at the second segment 174 is preferably substantially frustoconical in shape with the dimension of the internal passage 176 decreasing from a first diameter D1 at the first segment 172 through the second segment 174 to a second diameter D2 (see FIG. 4).

The external threads 142 of the second end portion 136 of the base connector 130 are engageable with the internal threads 180 of the first segment 172 of the collar 170.

The applicator tip diameter ATD1 is preferably smaller than the collar internal passage first diameter D1 and larger than the collar internal passage second diameter D2.

The applicator tip 100 is preferably placed against the concave surface 166 of the dish 160 and within the collar 170 and preferably at least partially in contact with the internal passage surface 176 at the second segment 174. The dish 160 may be positioned within the bore 138 of the base connector 130 with the flat surface 162 of the dish 160 placed closest to the motor 40.

Figure 7:
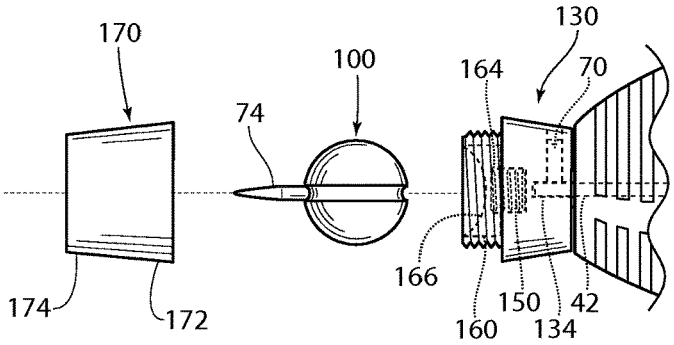
Figure 8A:
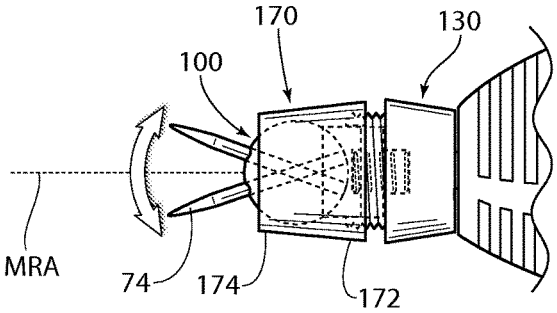
Figure 8B:
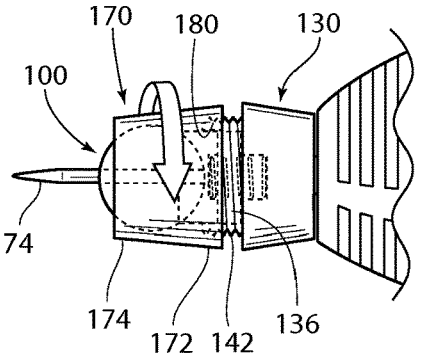

The optional biasing member 150, here a coil spring, may be positioned between the dish 160, preferably received within the recess 164, and the base connector 130 (see FIG. 7).

Figure 6:
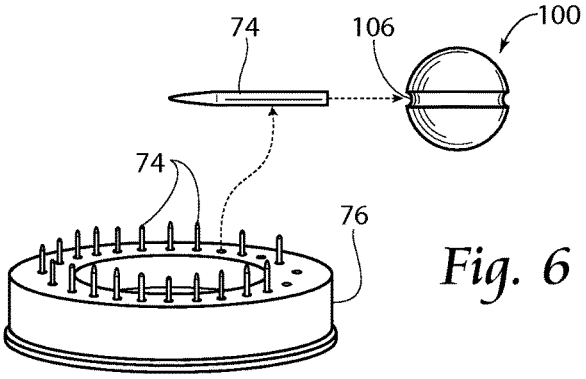
FIGS. 6-9 are views of steps of a method of installing and arranging an art medium within the tool of FIG. 1.
Figure 9:
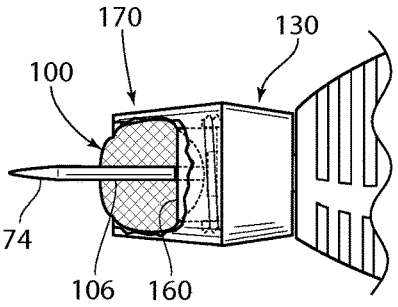

Turning now to FIGS. 6-9, a method of arranging at least one of the art mediums 74 within the first embodiment applicator tip 100 is shown. The method includes the general step of coupling an art medium 74 or art medium applicator and/or modifier to a motor 40. Application and/or modification of the medium to a substrate may then be performed. An art medium 74 may be provided singly, or a plurality of art mediums 74 may be provided in a tray 76, and a medium 74 may be inserted into the at least one cavity 106 of the applicator tip 100 (FIG. 6). The insertion of the medium 74 into the tip 100 may be performed temporally before or after the tip 100 has been mated with the coupling assembly 120 base 134 and/or the tool 10. The shaft 42 may be inserted into or received within the base connector bore 134 and secured with friction or a set screw 70 (FIG. 7). The applicator tip 100 is positioned within the coupling assembly 120, such as resting against the concave surface 166 of the dish 160 (FIG. 7). The collar 170 may be placed over the applicator tip 100, such that after the art medium 74 has been inserted, the art medium 74 extends longitudinally outward beyond the second segment 174 (FIG. 8A). If desired, an application angle of the art medium 74 may be adjusted relative to the motor rotational axis MRA by pivoting the applicator tip 100 (FIG. 8A). In this way, an application path of the medium 74 may be defined about the motor rotation axis MRA. A narrow application path is achieved by substantially aligning the cavity 106 substantially coaxially with the motor rotation axis MRA, and a wider application path may be defined by changing the respective angle therebetween. Once desired positioning of the tip 100 and/or medium 174 is achieved, the collar 170 may be secured to the base connector 130 by engaging the internal threads 180 of the collar first segment 172 with the external threads 142 of the base connector second end portion 136 (FIG. 8B), whereby the securing of the collar 170 to the base connector 130 clamps the applicator tip 100 with the art medium 74 in the preselected angle (FIG. 9).

According to the described first embodiment applicator tip 100, the art medium 74 or applicator may be positioned and secured in an orientation which positions the art medium 74 beyond the applicator tip diameter ATD1.

Figure 10:
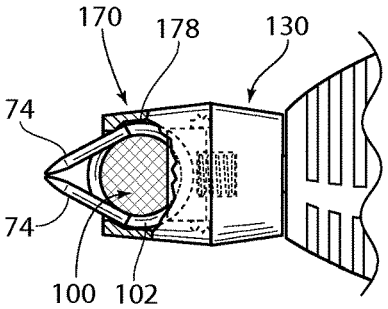
FIG. 10 is cut-away view of the applicator tip of the tool shown in FIG. 1 with two art mediums installed.

Additionally or alternatively, as shown in FIG. 10, at least one art medium 74 may be placed within the groove 102 of the applicator tip 100 and clamped between the internal passage surface 178 of the collar 170 and the groove 102 when the collar 170 is secured to the base connector 130.

Figure 11:
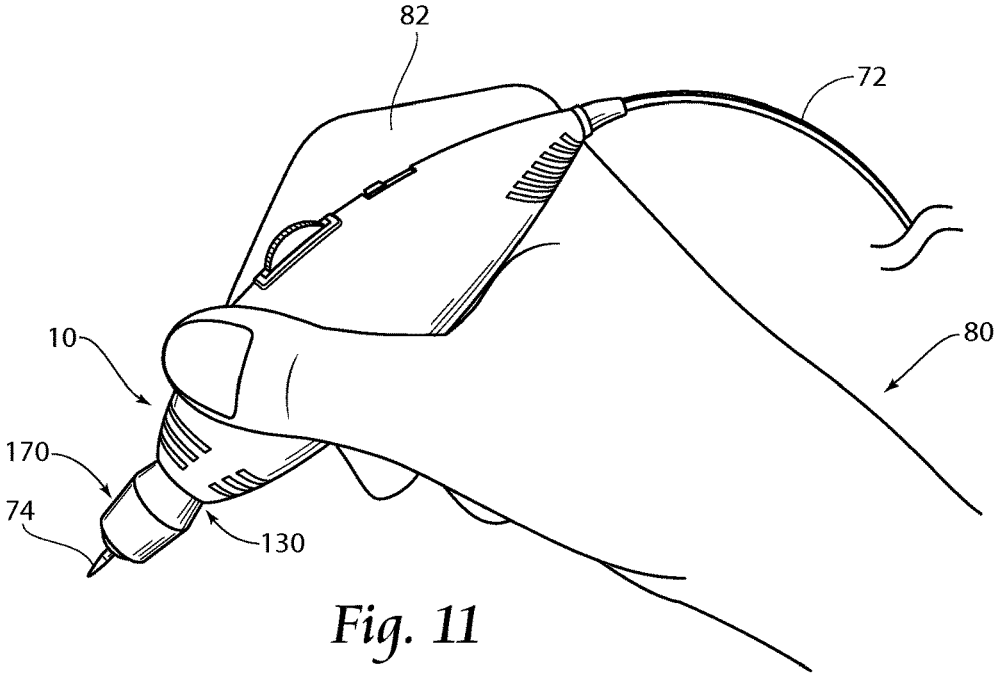
FIG. 11 is a perspective view of the tool shown in FIG. 1 in a user's hand.

FIG. 11 illustrates a user 80 with the tool 10 in a hand 82 ready for use. The tool 10 may then be powered on and the user 80 may apply the art medium 74 to a work surface (not shown).

Figure 12:
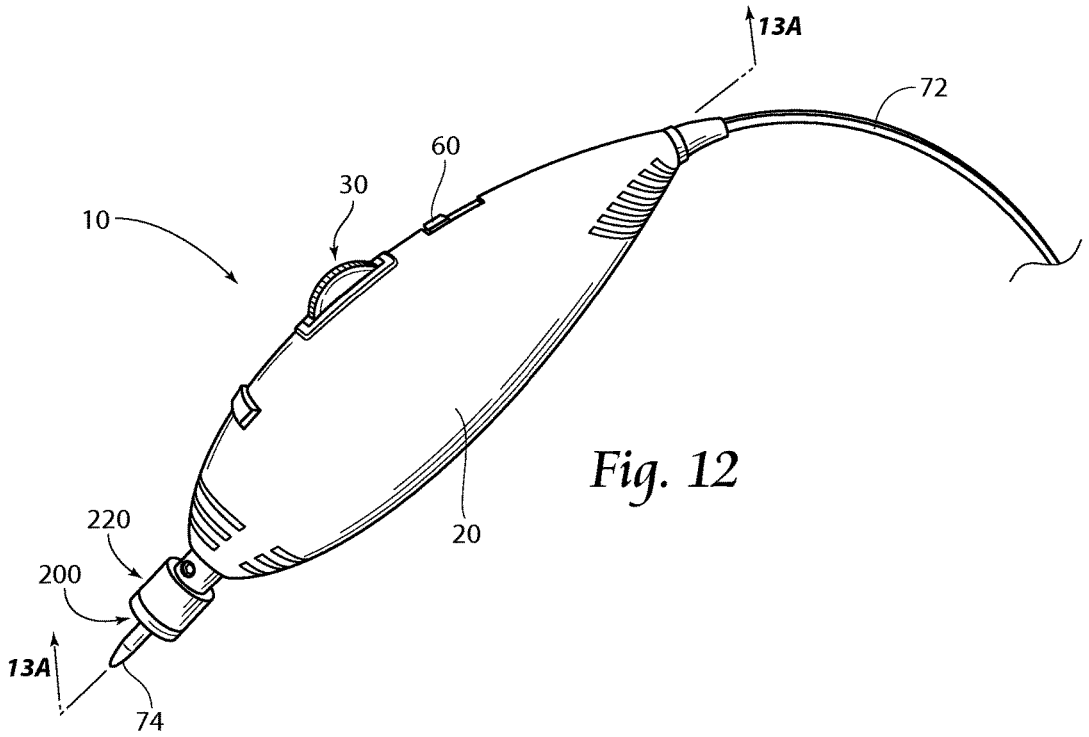
FIG. 12 is a perspective view of the art medium surface treatment tool of FIG. 1 with a second embodiment applicator tip.
Figure 13A:
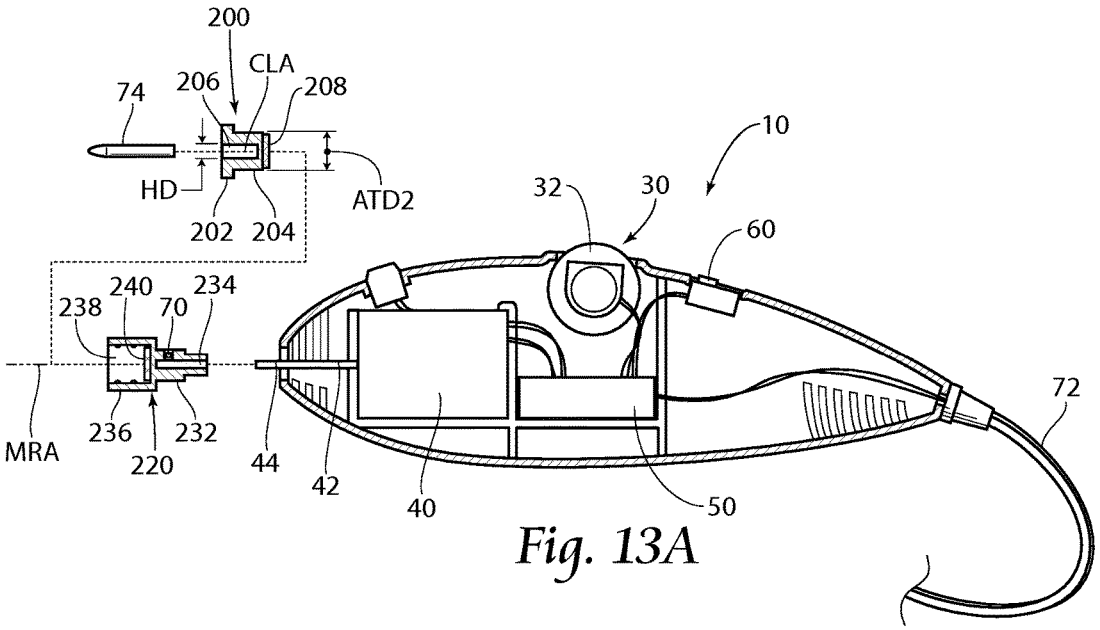
FIG. 13A is a cut-away exploded view of the tool shown in FIG. 12.
Figure 14:
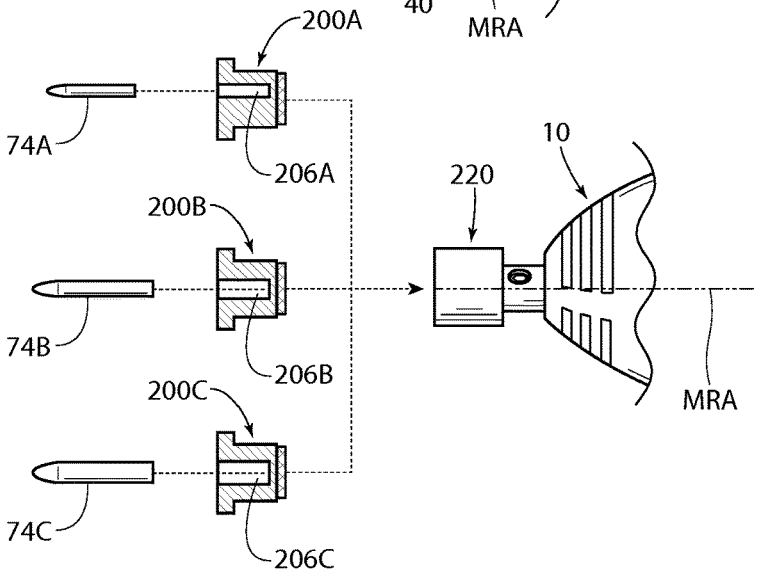
FIG. 14 is a partial cut-away exploded view of alternative embodiments of the applicator tip shown in FIG. 13A.
Figure 15:
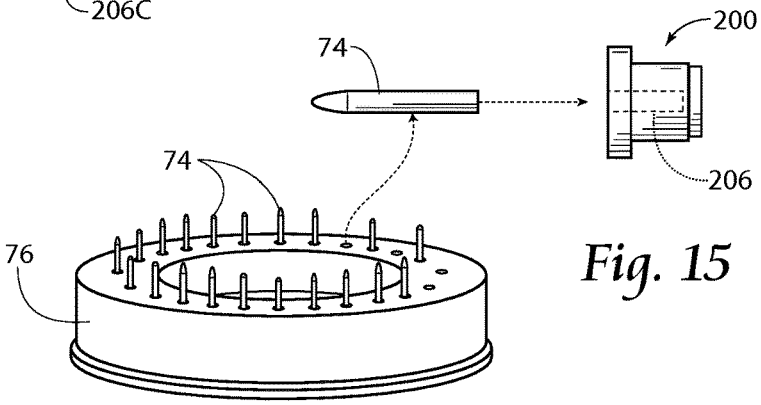
FIGS. 15-17 are views of steps of a method of installing an art medium within the tool of FIG. 13A.
Figure 16:
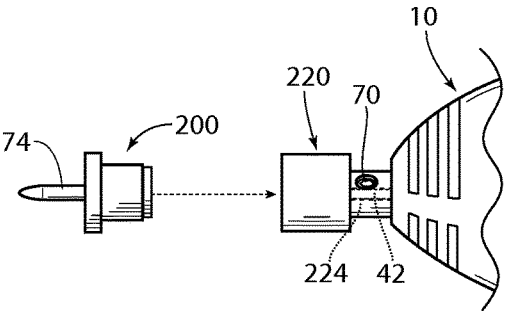
Figure 17:
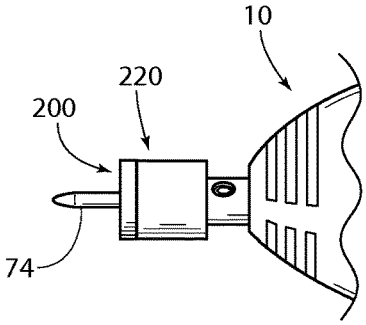
Figure 18:
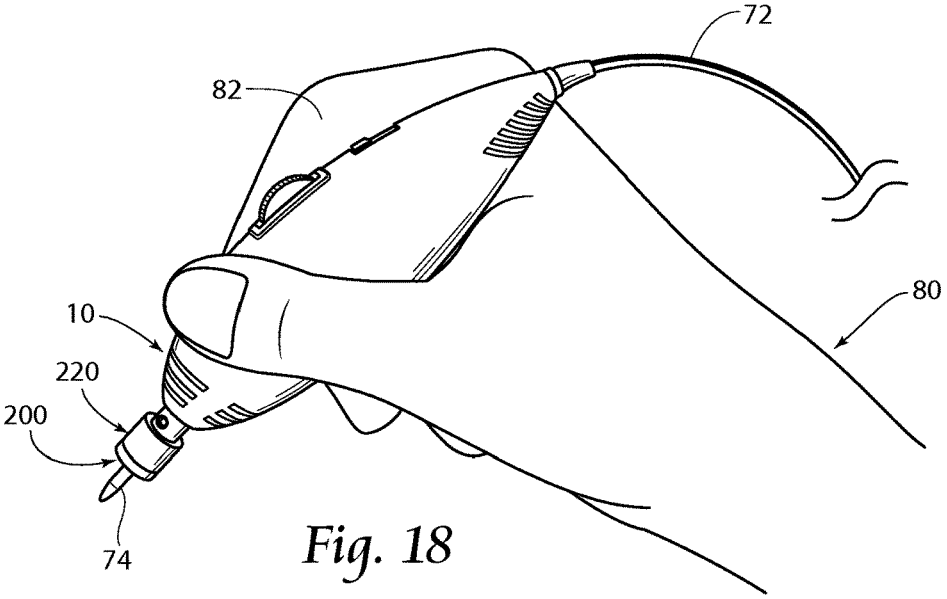
FIG. 18 is a perspective view of the tool shown in FIG. 13A in a user's hand.

FIGS. 12, 13A, and 14 illustrate a second embodiment of the applicator tip 200 and a second embodiment of the coupling assembly 220. Looking to FIG. 13A, the applicator tip 200 is shown preferably comprising a substantially cylindrical shape with a first end 202, a second end 204, and a diameter ATD2, and may be comprised of a material having an elastic characteristic. The applicator tip 200 preferably has a substantially cylindrical hole 206 with a diameter HD extending inwards from the first end 202 towards the second end 204 and having a central axis CA. A first magnet 208 may be secured to the second end 204. The first magnet 208 is preferably a neodymium magnet, but other types of magnets are contemplated.

Additionally or alternatively, various applicator tips 200 may be configured for various art mediums 74 based on the type of medium and/or the diameter of the art medium 74. FIG. 14 illustrates a non-limiting example of three applicator tips 200A, 200B, 200C having three different sized holes 206A, 206B, 206C sized for various sized art mediums 74A, 74B, 74C from at least about 0.5 millimeters in diameter to about 8 millimeters.

The first applicator tip 200A is shown with the hole central axis CA offset from the motor rotational axis MRA. It is contemplated that the hole central axis CA may be disposed at various angles from the motor rotational axis MRA.

The applicator tip 200 is preferably connected to the shaft 42 via the coupling assembly 220. The applicator tip 200 and the coupling assembly 220 are removably attachable for easy changing of the applicator tip 200. The coupling assembly 220 comprises a first end portion 232 and a second end portion 236. A bore 234 may be formed within the first end portion 232 to receive the shaft 42. The coupling assembly 220 is preferably removably affixed to the shaft 42 via a set screw 70. A pocket 238 may be formed within the second end portion 236 of the coupling assembly 220 opposite the bore 234 of the first end portion 232. A second magnet 240 may be disposed within the pocket 238.

A method for attaching the art medium 74 to the second embodiment applicator tip 200 and tool 10 is shown in FIGS. 15-18. The method comprises providing a plurality of art mediums 74 in a tray 76, inserting one of the art mediums 74 into the hole 206 of the applicator tip 200 (FIG. 15), receiving the shaft 42 within the coupling assembly bore 234 and securing the coupling assembly 220 to the shaft 42 with set screw 70, and inserting the applicator tip 200 within the coupling assembly pocket 238 (FIG. 16), shown fully assembled in FIG. 17.

Figure 13B:
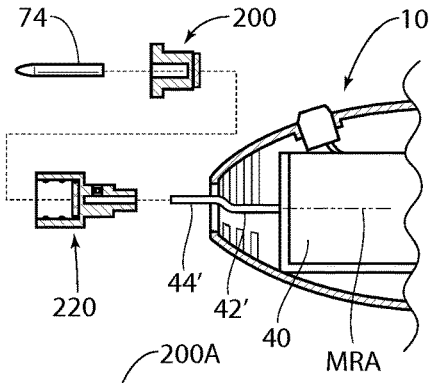
FIG. 13B is a cut-away view of the tool shown in FIG. 13A with a second shaft embodiment.

A second shaft embodiment 42' is shown in FIG. 13B. The shaft 42' has an attachment portion 44' offset from the motor rotational axis MRA. Depicted here, the attachment portion 44' may be substantially parallel with the motor rotational axis MRA, but it is contemplated that the shaft attachment portion 44' may be disposed an angle from 0° to 90° measured from the motor rotational axis MRA.

It is contemplated that the shaft 42, 42' may be fluted or comprise a keyway to receive splines or a key in the coupling assembly bore 134, 234.

Figure 19:
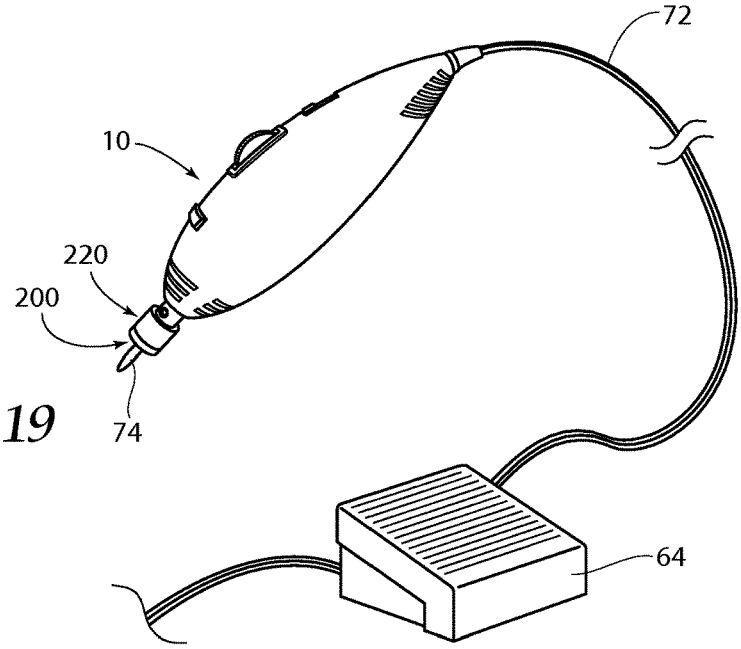
FIG. 19 is a perspective view of the tool shown in FIG. 13A with an additional or alternative foot pedal power control.
Figure 20A:
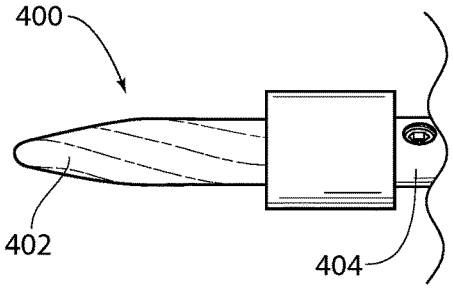
FIGS. 20A-20E depict various embodiments of medium applicators or modifiers, which may be used in accord with the present invention.
Figure 20B:
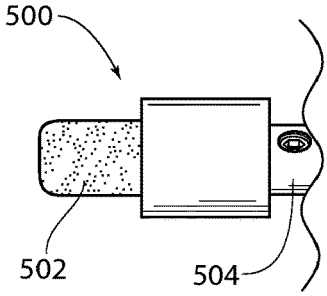
Figure 20C:
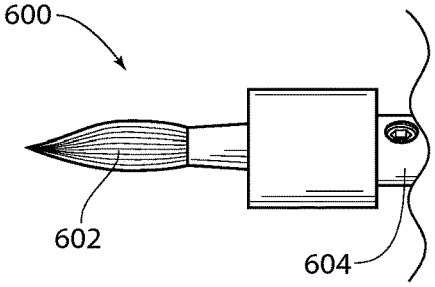
Figure 20D:
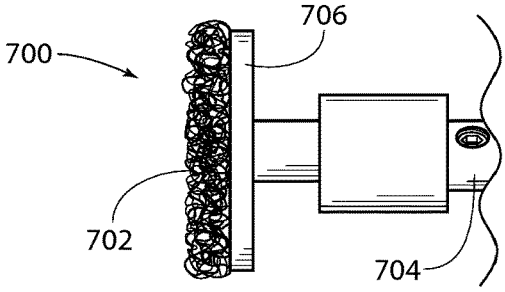
Figure 20E:
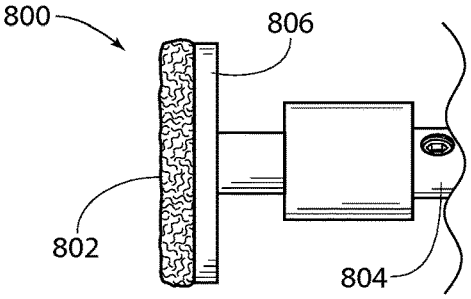

As shown in FIG. 19, a foot pedal 64 may be incorporated in series with the cord 72 connecting the tool 10 to the power source (not shown). The foot pedal 64 may be used as an on/off switch additionally or alternatively to the other power switch 60 or optical sensor 62 and/or the foot pedal 64 may be used as a speed control in a manner similar to that of the motor speed control 30 disclosed above FIGS. 20A-20E depict various embodiments of medium applicators or modifiers, which may be used in accord with the present invention. As a medium modifier, FIG. 20A shows a smudge tool 400, which may include a tortillon 402 coupled to a shaft 404. The tortillon 402 may be used to blend or smudge art medium (e.g., graphite, colored pencil, charcoal, pastel, etc.) that was applied to a work surface (e.g., canvas, paper, wood, scratchboard, etc.) prior to such blending or smudging, and preferably by hand or with a different tool or with a different applicator tip on the same tool. FIG. 20B shows another medium modifier in the form of an eraser tool 500, generally including a piece of rubber 502 coupled to a shaft 504, which may be used to remove or smudge art medium (e.g., graphite, colored pencil, charcoal, pastel, etc.) that was applied to a work surface (e.g., canvas, paper, wood, scratchboard, etc.) prior to such removal or smudging, and preferably by hand or with a different tool or with a different applicator tip on the same tool. As a medium applicator and/or modifier, a paint brush tool 600 is shown in FIG. 20C. The paint brush tool 600 generally includes a plurality of bristles 602 coupled to a shaft 604. The bristles 602 can be synthetic (e.g. nylon and/or polyester) or natural bristles (e.g., sable, squirrel, hog, camel, ox, pony, or goat), and may be formed into a desired brush pattern, such as flat, comb, filbert, round, chisel, shader, mop, or fan. The paint brush tool 600 may be used to apply and/or modify art medium (e.g., paint, graphite, colored pencil, charcoal, pastel, etc.) on a work surface (e.g., canvas, paper, wood, scratchboard, etc.), where the medium is applied to the work surface with the tool 600 or prior to modification by hand or with a different tool or with a different applicator tip on the same tool. FIG. 20D depicts a medium applicator and/or modifier in the form of nonwoven filament head 700, which may be used to texture, pattern, or remove art medium (e.g., paint, graphite, colored pencil, charcoal, pastel, etc.) on or from a work surface (e.g., canvas, paper, wood, scratchboard, etc.), where the medium is applied to the work surface with the head 700 or prior to modification by hand or with a different tool or with a different applicator tip on the same tool. The tool 700 includes a nonwoven filament material 702 coupled to a shaft 704. Such coupling may be through a disc member 706, such as the nonwoven material 702 being adhered thereto, or directly to the shaft 704. The nonwoven material 702 may be, for example, steel wool and/or cotton. FIG. 20E depicts a medium applicator and/or modifier in the form of a pad tool 800, which may be used to texture, pattern, or remove art medium (e.g., paint, graphite, colored pencil, charcoal, pastel, etc.) on or from a work surface (e.g., canvas, paper, wood, scratchboard, etc.), where the medium is applied to the work surface with the tool 800 or prior to modification by hand or with a different tool or with a different applicator tip on the same tool. The tool 800 includes a pad 802 coupled to a shaft 804. Such coupling may be through a disc member 806, such as the pad 802 being adhered thereto, or directly to the shaft 804. The pad 802 may be constructed from one or more of open- or closed-cell foam, leather, paper laminate, and cloth (e.g. woven) material.

The shaft of each tool depicted in FIGS. 20A-20E may be adapted to cooperate with the first applicator tip 100 or second 200, to be aligned coaxially with, parallel with but offset from, or at an angle with respect to the motor rotational axis MRA.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A hand tool comprising:

a shaft rotatable about an axis of rotation;

a coupling assembly secured to the shaft;

a substantially spherical applicator tip with a cavity, the applicator tip being at least partially disposed within the coupling assembly;

an art medium receivable into the cavity;

wherein the coupling assembly comprises a base connector and a collar threadably engaged with the base connector, wherein the applicator tip is secured by the cooperation of the base connector and the collar;

the base connector comprising a first end into which a bore is formed and a second end opposite the first end comprising a pocket formed therein, wherein the bore is secured about the shaft;

a dish received within the pocket; and a biasing member positioned between and engaging the dish and the base connector;

whereby the art medium is coupled to and moved by the shaft, at least a portion of the art medium traveling through an application path surrounding the axis of rotation.

2. A hand tool according to claim 1, further comprising an electric motor into which the shaft is journaled.

3. A hand tool according to claim 1, further comprising a cable to electrically couple the tool to an electric mains.

4. A hand tool according to claim 1, wherein the art medium is at least one of graphite, charcoal, wax crayon, chalk, pastel, gum-based pencil core, resin-based pencil core, wax-based pencil core, gum-impregnated pencil core, resin-impregnated pencil core, and wax-impregnated pencil core.

5. A hand tool according to claim 1, wherein the dish comprises a concave surface abutting the applicator tip.

* * * * *